US009428852B2

(12) United States Patent
Gautier et al.

(10) Patent No.: US 9,428,852 B2
(45) Date of Patent: Aug. 30, 2016

(54) TABLE AND A METHOD FOR NEEDLING A TEXTILE STRUCTURE FORMED FROM AN ANNULAR FIBER PREFORM, WITH RADIAL OFFSETTING OF THE NEEDLING HEAD

(71) Applicant: MESSIER-BUGATTI-DOWTY, Vélizy-Villacoublay (FR)

(72) Inventors: Patrice Gautier, Frontonans (FR); Franck Ribas, St Pierre la Palud (FR)

(73) Assignee: MESSIER-BUGATTI-DOWTY, Velizy-Villacoublay (FR)

( * ) Notice: Subject to any disclaimer, the term of this patent is extended or adjusted under 35 U.S.C. 154(b) by 148 days.

(21) Appl. No.: 14/309,181

(22) Filed: Jun. 19, 2014

(65) Prior Publication Data

US 2014/0373322 A1 Dec. 25, 2014

(30) Foreign Application Priority Data

Jun. 20, 2013 (FR) ..... 13 55814

(51) Int. Cl.

| | |
|---|---|
| ***D04H 18/02*** | (2012.01) |
| ***D04H 1/46*** | (2012.01) |
| ***D04H 1/4242*** | (2012.01) |
| ***D04H 1/498*** | (2012.01) |

(52) U.S. Cl.

CPC ..... *D04H 18/02* (2013.01); *D04H 1/4242* (2013.01); *D04H 1/498* (2013.01)

(58) Field of Classification Search

CPC ..... D04H 18/02; D04H 18/00; D04H 1/46; D04H 1/498; D04H 3/102; D04H 3/105; D04H 5/02; D04H 1/4242

USPC ..... 28/107, 115, 108, 109, 110, 112, 113, 28/114

See application file for complete search history.

(56) References Cited

U.S. PATENT DOCUMENTS

| | | | | |
|---|---|---|---|---|
| 4,378,618 A * | 4/1983 | Dilo | D04H 18/02 28/110 |
| 5,513,423 A * | 5/1996 | Jakob | D04H 18/02 28/107 |
| 5,758,394 A * | 6/1998 | Linck | D04H 18/02 28/107 |
| 5,858,890 A * | 1/1999 | Sheehan | B29C 70/24 428/408 |

(Continued)

FOREIGN PATENT DOCUMENTS

| | | | |
|---|---|---|---|
| FR | 2626294 | 7/1989 | |
| FR | 2735456 A1 * | 12/1996 | D04H 1/46 |

(Continued)

OTHER PUBLICATIONS

French Search Report dated Aug. 26, 2013 for Appln. No. FR1355814.

*Primary Examiner* — Amy Vanatta

(74) *Attorney, Agent, or Firm* — Pillsbury Winthrop Shaw Pittman LLP

(57) ABSTRACT

A circular needling table for needling a textile structure made from an annular fiber preform, includes: a horizontal top on which an annular fiber preform is to be placed; a driver system constructed and arranged to drive the fiber preform in rotation about a vertical axis of rotation; and a needling device for needling the fiber preform, the device including a needling head extending over a predetermined angular sector of the table top and to be driven with vertical reciprocating motion relative to the table top, and a mover system constructed and arranged to move the needling head in a direction that is radial relative to the axis of rotation of the fiber preform.

8 Claims, 3 Drawing Sheets

(56) References Cited

U.S. PATENT DOCUMENTS

| | | | | |
|---|---|---|---|---|
| 6,009,605 | A * | 1/2000 | Olry | B29B 11/16 28/107 |
| 6,347,440 | B1 * | 2/2002 | Duval | D04H 18/02 28/107 |
| 6,363,593 | B1 * | 4/2002 | Duval | D04H 18/02 28/107 |
| 6,367,130 | B1 * | 4/2002 | Duval | D04H 18/02 28/107 |
| 2005/0172465 | A1 * | 8/2005 | Duval | B29B 11/16 28/101 |
| 2005/0235471 | A1 * | 10/2005 | Delecroix | D04H 1/498 28/107 |
| 2011/0154628 | A1 * | 6/2011 | Vincent | D04H 18/02 28/107 |
| 2011/0154629 | A1 * | 6/2011 | Delecroix | D04H 18/02 28/108 |

FOREIGN PATENT DOCUMENTS

| | | |
|---|---|---|
| WO | WO 92/04492 | 3/1992 |
| WO | WO 02/088449 | 11/2002 |
| WO | WO 02/088451 | 11/2002 |

* cited by examiner

TABLE AND A METHOD FOR NEEDLING A TEXTILE STRUCTURE FORMED FROM AN ANNULAR FIBER PREFORM, WITH RADIAL OFFSETTING OF THE NEEDLING HEAD

CROSS-REFERENCE TO RELATED APPLICATIONS

This application claims priority to French Patent Application No. 1355814, filed Jun. 20, 2013, the entire content of which is incorporated herein by reference in its entirety.

FIELD

The present invention relates to the general field of needling an annular fiber preform in order to make needled textile structures.

BACKGROUND

It is known to use a needling table of circular type for fabricating annular textile structures that are to constitute the fiber reinforcement of annular parts made of composite material, in particular brake disks, such as disks made of carbon/carbon (C/C) composite material for airplane brakes.

Typically, a circular needling table comprises a horizontal top on which an annular fiber preform is placed, drive means (usually friction drive means) for driving the fiber preform in rotation around a vertical axis of rotation, and a needling device having a needling head that occupies an annular sector of the table top and that is driven with vertical reciprocating motion relative to the table top.

The annular fiber preform is laid on the top of the needling table in mutually superposed layers. The fiber preform is driven to rotate about the vertical axis and it is struck by the needling head whenever it passes under the needling head so as to bond together the various layers. The table is caused to move downwards in steps as additional layers of the fiber preform are put into place and needled. Reference may be made to Document WO 02/088451, which describes an embodiment of such a needling table.

The mechanical characteristics of the final product as obtained in this way depend strongly on the real density of needling used in the fiber reinforcement. This real density of needling depends in particular on the density of needling per unit area, on the penetration depth of the needles, on the size of the downward step of the table, and on functional characteristics of the needles.

With present needling methods, it is sometimes difficult to obtain good uniformity of needling over the entire surface area of the fiber preform. In addition, the expansion of the fibers of the fiber preform that is obtained as a result of passing the needles is not always optimized.

SUMMARY

An aspect of the present invention thus proposes a needling table and an associated method that mitigate such drawbacks by enabling the fiber preform to be needled more uniformly, while encouraging expansion of the fibers.

This aspect is achieved in an embodiment by a circular needling table for needling a textile structure made from an annular fiber preform, the table comprising a horizontal top on which an annular fiber preform is to be placed, a driver system or arrangement constructed and arranged to drive the fiber preform in rotation about a vertical axis of rotation, and a needling device for needling the fiber preform, the device comprising a needling head extending over a predetermined angular sector of the table top and driven with vertical reciprocating motion relative to the table top, the table also including a mover system or arrangement constructed and arranged to move the needling head in a direction that is radial relative to the axis of rotation of the fiber preform.

The needling head is controlled so as to move radially during the process of needling the fiber preform so as to create offsets in the positions of the needles that strike the fiber preform. This control of the needling head thus makes it possible to obtain needling of the fiber preform that is more uniform and enhances the expansion of the fibers in the preform, thereby improving the infiltration of the matrix material into the pores of the preform.

The needling device may comprise a vertical support driven with vertical reciprocating motion relative to the table top and having the needling head mounted thereon, and an electric motor mounted on the support and having an outlet shaft coupled to the needling head in order to move it along a direction that is radial relative to the axis of rotation of the fiber preform. Under such circumstances, the motor is, in an embodiment, a linear stepper motor.

In an embodiment, the support of the needling device further comprises an end-of-stroke sensor for radial movement of the needling head. This sensor serves to set the needling head to "zero".

Correspondingly, an embodiment of the invention also provides a method of needling a textile structure formed from an annular fiber preform, the method comprising placing an annular fiber preform in superposed layers on a horizontal table top, causing the annular fiber preform to rotate on the table top about a vertical axis of rotation, and needling the fiber preform by means of a needling head extending over a predetermined angular sector of the table top and driven with vertical reciprocating motion relative to the table top, the method further comprising, during the needling of the fiber preform, moving the needling head in a direction that is radial relative to the axis of rotation of the fiber preform.

The needling head may be moved radially through a step of the same predetermined size between two consecutive revolutions of the fiber preform about the axis of rotation.

Alternatively, the needling head may be moved radially through a step of the same predetermined size for each new revolution of the fiber preform around the axis of rotation.

The step size and the number of radial movements of the needling head are a function of the desired needling density.

BRIEF DESCRIPTION OF THE DRAWINGS

Other characteristics and benefits of the present invention appear from the following description made with reference to the accompanying drawings, which show an embodiment having no limiting character. In the figures.

DETAILED DESCRIPTION

The invention applies to any circular needling process in which annular textile layers (or plies) are stacked and needled together on a table top in order to form a needling fiber preform of annular shape.

These layers may be formed beforehand as rings or as juxtaposed ring sectors that are cut out from a woven fabric or from a non-woven material made of unidirectional or multidirectional fibers. They may also be formed by turns wound flat from a feeder device such as that described in patent application WO 02/088449, or by turns made from deformed braids, or indeed by turns formed from a deformable two-dimensional texture (helical braid or woven fabric).

Figure 1A:
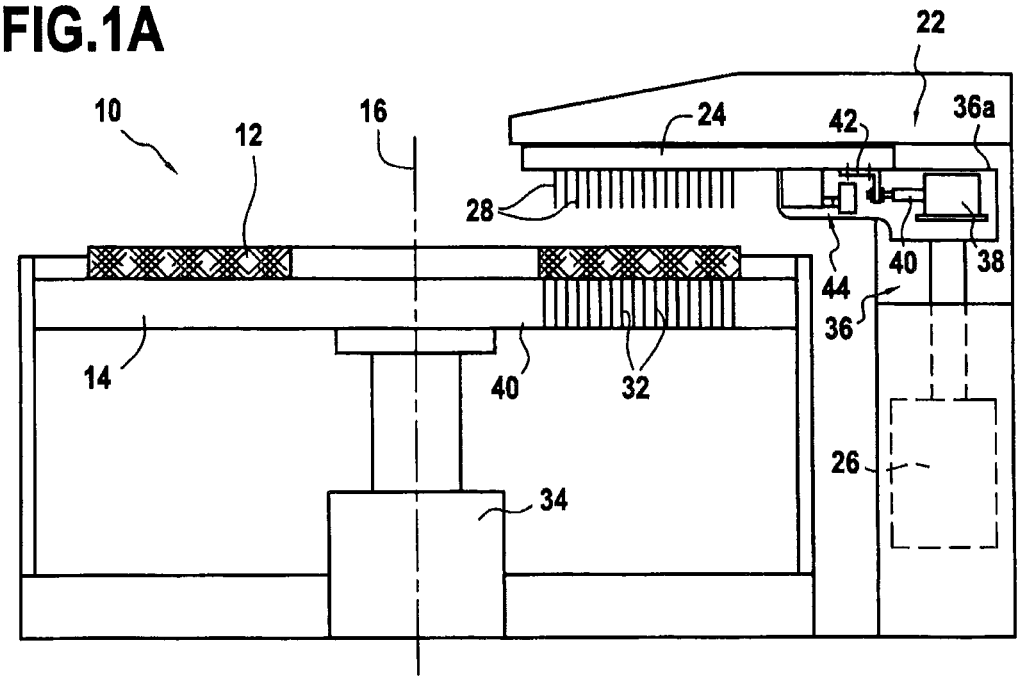
FIGS. 1A-1B and 2 are diagrams showing a circular needling table in accordance with an embodiment of the invention, respectively in side view and in plan view.
Figure 1B:
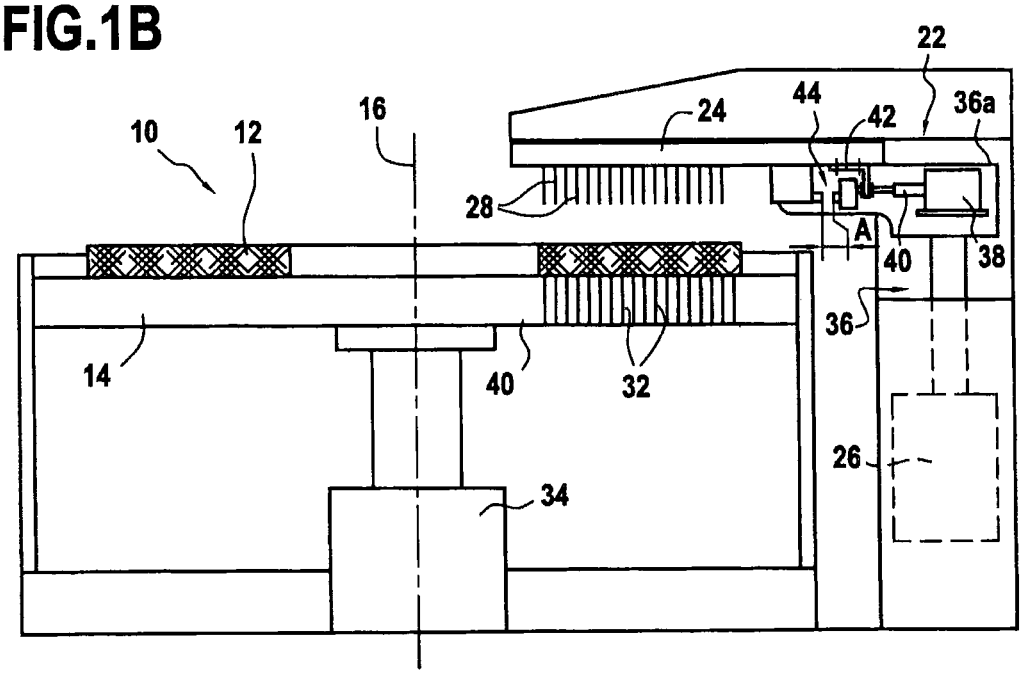
Figure 2:
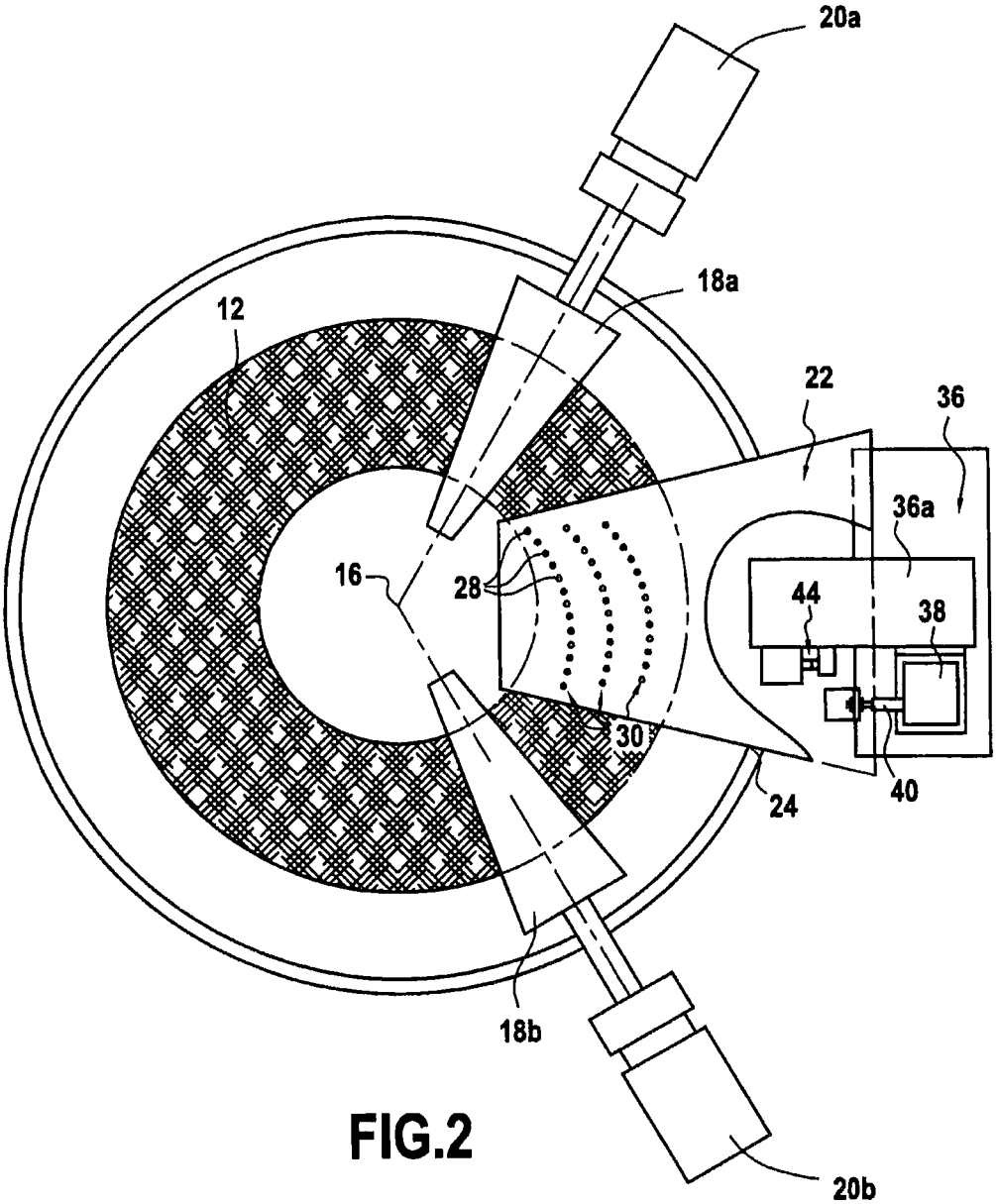

A circular needling table 10 in accordance with an embodiment of the invention for performing such a needling process is shown in highly diagrammatic manner in FIGS. 1A-1B and 2.

The fiber annular preform 12 for needling is applied directly onto a horizontal top 14 of the needling table. This preform 12 is driven in rotation about a vertical axis of rotation 16, e.g. by means of conical rollers 18*a* and 18*b* that are maintained in permanent contact with the preform (FIG. 2).

Typically, this device for driving the preform in rotation comprises two conical rollers spaced apart from each other by 120° and each actuated by an independent gear motor 20*a*, 20*b*. Nevertheless, a common motor coupled to an appropriate drive could also be envisaged.

In more general manner, other system or arrangement for driving the fiber preform in rotation about the vertical axis 16 could be envisaged.

The annular preform 12 set into rotation in this way moves past a needling device 22 comprising in particular a needling head 24 that overlies a predetermined angular sector of the horizontal top 14. This needling head is driven with reciprocating vertical motion (i.e. it moves up and down) relative to the top 14 by means of an appropriate driver device 26 (e.g. of the crank-and-slider type).

The needling head 24 carries a determined number of needles 28 that have barbs, hooks, or forks for taking fibers from the stacked layers of the annular preform and for transferring them through the layers when the needles penetrate into the preform. In known manner, these needles 28 are arranged in a plurality of needle rows 30.

The top 14 of the needling table also has a series of vertical perforations 32 located in register with the needles 28 of the needling head in order to pass the needles while needling the initial layers of the annular preform. Each time a new ply is needled, the top of the needling table is moved vertically by appropriate driver means 34 through a downward step of determined size corresponding substantially to the thickness of a needled layer.

In accordance with the embodiment of the invention, the needling device 22 also has a mover system or arrangement for enabling the needling head 24 to move in a radial direction relative to the axis of rotation 16 of the fiber preform 12.

Thus, in the example shown in FIGS. 1A-1B and 2, the needling device 22 has a vertical support 36 on which the needling head 24 is mounted, this support being driven with reciprocating vertical motion by a driver device 26.

The support 36 of the needling device carries an electric motor 38 in its top portion, which motor has an outlet shaft 40 coupled to the needling head 24 in order to move it in a direction that is radial relative to the axis of rotation of the fiber preform.

It is desirable to use a linear stepper motor 38 having an outlet shaft 40 that moves in linear manner. This outlet shaft is oriented in a radial direction and is connected to the needling head, e.g. by means of a bracket 42.

As shown in FIGS. 1A-1B and 2, the needling head 22 is mounted on the support 36 of the needling device in such a manner as to be capable of sliding along a top edge 36*a* thereof between two extreme positions, namely a retracted position (FIG. 1A) and an advanced position (with the advance being represented diagrammatically by the distance A in FIG. 1B).

Depending on the position of the needling head between these two extreme positions, the impact of the needles 28 carried by the needling head against the fiber preform situated beneath it is not the same (the rows of needles 30 strike at different locations on each occasion the needling head is moved). It can thus be said that a radial offset is introduced into the needling of the fiber preform.

The motor 38 for moving the needling head 22 is controlled by a control device (not shown) that is programmed depending on the parameters selected from the needling range. Thus, depending on the needling criteria that are to be applied, the control device controls the needling head during the entire process of needling the textile structure to be made.

For example, the control device may be programmed to introduce a radial offset through the same predetermined step size between two consecutive turns of the fiber preform about its axis of rotation.

In other words, in such an example, the needling head is positioned in one of its extreme positions (FIG. 1A or FIG. 1B) for the entire first revolution of the fiber preform. Then for the entire following revolution the needling head is offset radially to its other extreme position through a step of predetermined size p (e.g. corresponding to half of the distance between two adjacent rows 30 of needles). During the following revolution, the needling head is returned to its original extreme position, and so on.

Alternatively, the control device may be programmed to introduce a radial offset through steps having the same predetermined size for each new revolution of the fiber preform (i.e. no offset for the first revolution, an offset through a step of predetermined size p for the second revolution, and offset through another step of size p, giving 2p for the following revolution, an offset through another step of size p giving 3p for the following revolution, etc.).

Furthermore, an end-of-stroke sensor 44 is beneficially positioned on the support 36 of the needling device. This sensor 44 serves to detect when the needling head 22 has reached one of its extreme positions (e.g. the retracted position) in order to initialize the process of controlling the needling head, i.e. in order to set the needling head at the origin "0" before starting the offsetting sequence.

It will be appreciated that it is possible to envisage other ways of programming the control device for introducing radial offsets in the needling. For example, it is possible to envisage no offset for the first three revolutions of the fiber preform, and then to use the same offset through a step of size p for the following three revolutions, then no offset for the following three revolutions, etc.

Figure 3B:
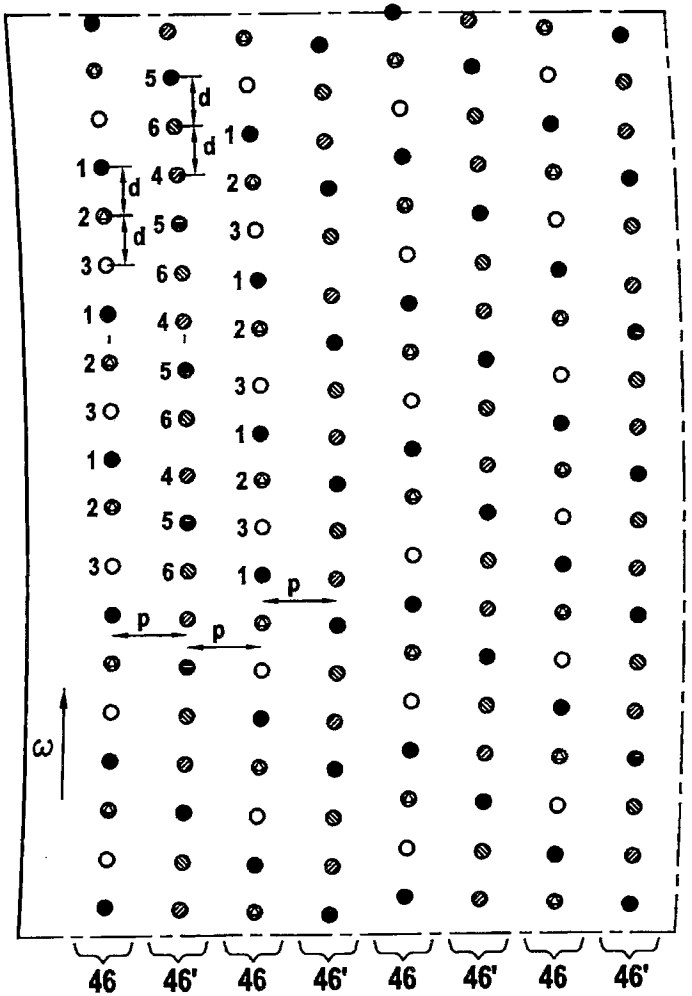
FIGS. 3A and 3B show a comparative example of implementing the needling method of the invention by means of the table of FIGS. 1A-1B and 2.
Figure 3A:
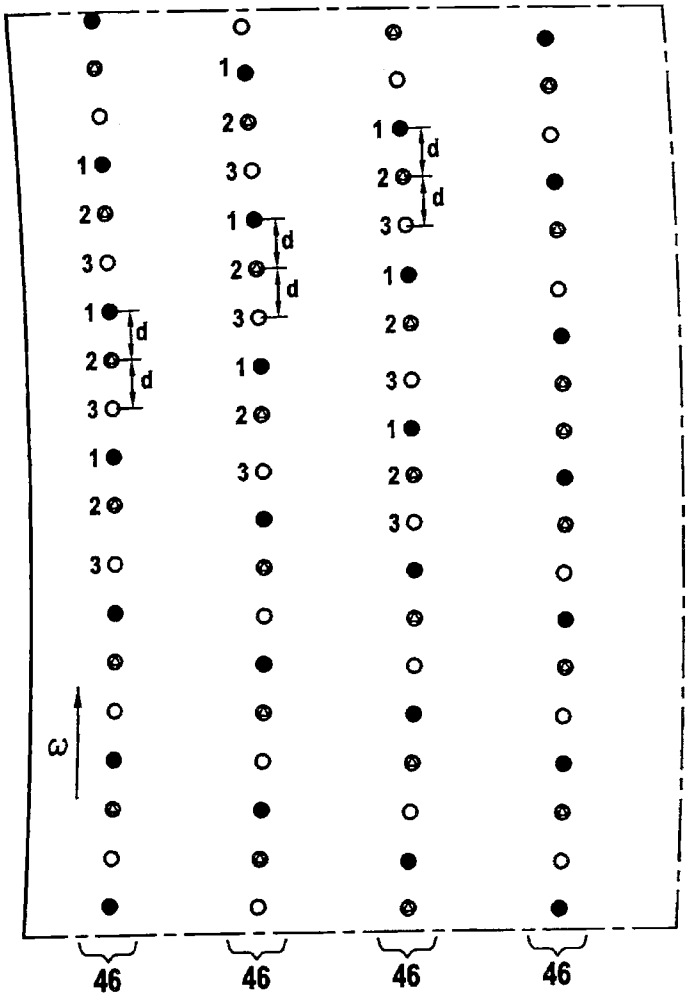

FIGS. 3A and 3B show the results of needling obtained by a prior art needling method (FIG. 3A) and by a needling method in accordance with the invention (FIG. 3B), i.e. in which a radial needling offset is introduced.

FIG. 3A shows the impact of the needles of a needling head controlled as in the prior art, the needling head being provided with four rows of needles. The direction of rotation of the preform is represented by arrow Ω. The needling pattern obtained comprises four rows of punctures 46 corresponding to the four rows of needles in the needling head. The needling is performed by causing the fiber preform to execute six complete revolutions about its axis of rotation.

In FIG. 3A, it can be seen that a circumferential offset is introduced on each revolution of the fiber preform. Thus, between the first and second revolutions, a circumferential offset d is introduced, and again between the second and third revolutions, and so on. In particular, the impacts of the needles on the fourth, fifth, and sixth revolutions coincide with the impacts of the needles on the first, second, and third revolutions, respectively.

Thus, the punctures made during the first and fourth passes of the fiber preform under the needling head are given the reference "1", the punctures performed during the second and fifth passes are given the reference "2", and the punctures performed during the third and sixth passes are given the reference "3".

This circumferential offset d is introduced deliberately by acting on the speed of advance of the fiber preform around its axis of rotation so as to increase as much as possible the number of locations that are impacted by the needles.

FIG. 3B uses the same needling head having four rows of needles and likewise performing six complete revolutions of the fiber preform about its axis of rotation, but with the needling head being controlled in accordance with the invention, i.e. by introducing a radial offset.

More precisely, in addition to the circumferential offset d that is introduced by acting on the forward speed of the fiber preform, a radial offset is added through a predetermined step size p after the first three revolutions of the fiber preform.

As a result, the impacts of the needles during the first, second, and third revolutions are identical to the impacts of the needling performed in FIG. 3A (punctures given references "1" to "3"), whereas the impacts for the fourth, fifth, and sixth revolutions are offset radially through a step size p towards longer radii of the preform (these punctures given references "4" to "6"). In this example, the step size p corresponds substantially to half the distance between two adjacent rows of needles.

By comparing FIGS. 3A and 3B, it can clearly be seen that introducing a radial offset during the needling makes it possible to obtain needling of the fiber preform that is more uniform and thereby enhancing expansion of the fibers of the preform. In particular, the needling pattern that is obtained in this example comprises four rows of punctures 46 corresponding to the four rows of needles of the needling head and for additional rows of punctures 46' created by the radial offset and formed between the rows of punctures 46.

The invention claimed is:

1. A circular needling table for needling a textile structure made from an annular fiber preform, the table comprising:

a horizontal top on which an annular fiber preform is to be placed;

a driver system constructed and arranged to drive the fiber preform in rotation about a vertical axis of rotation;

a needling device for needling the fiber preform, the device comprising a needling head extending over a predetermined angular sector of the table top and to be driven with vertical reciprocating motion relative to the table top; and a mover system constructed and arranged to move the needling head during the needling of the fiber preform in a direction that is radial relative to the axis of rotation of the fiber preform, wherein the needling device comprises:

a vertical support to be driven with vertical reciprocating motion relative to the table top and having the needling head mounted thereon; and an electric motor mounted on the support and having an outlet shaft coupled to the needling head in order to move it along a direction that is radial relative to the axis of rotation of the fiber preform, and wherein the motor is a linear stepper motor and said motor is configured to position the needling head in at least three different radial positions relative to the axis of rotation of the fiber preform and wherein the linear stepper motor positions the needling head at different radial positions between successive turns of the fiber preform about the vertical axis of rotation.

2. The table according to claim 1, wherein the needling head is suitable for sliding along a top edge of the support.

3. The table according to claim 1, wherein the support of the needling device further comprises an end-of-stroke sensor for radial movement of the needling head.

4. The table according to claim 1, wherein the successive turns are consecutive turns.

5. A method of needling a textile structure formed from an annular fiber preform, the method comprising:

placing an annular fiber preform in superposed layers on a horizontal table top;

causing the annular fiber preform to rotate on the table top about a vertical axis of rotation;

needling the fiber preform by means of a needling head extending over a predetermined angular sector of the table top and driven with vertical reciprocating motion relative to the table top; and during the needling of the fiber preform, moving the needling head in a direction that is radial relative to the axis of rotation of the fiber preform, wherein the needling of the fiber preform comprises at least positioning the needling head at a first radial position relative to the axis of rotation of the fiber preform, needling the fiber preform by means of the needling head thus positioned at this first radial position, then positioning the needling head at a second radial position relative to the axis of rotation of the fiber preform, said second radial position being offset from the first radial position and then needling the fiber preform by means of the needling head thus positioned at this second radial position.

6. The method according to claim 5, wherein the needling head is moved radially through a step of the same predetermined size between two consecutive revolutions of the fiber preform about the axis of rotation.

7. The method according to claim 5, wherein the needling head is moved radially through a step of the same predetermined size for each new revolution of the fiber preform around the axis of rotation.

8. The method according to claim 5, wherein a step size and a number of radial movements of the needling head are a function of the desired needling density.

* * * * *